United States Patent [19]

Tachikawa et al.

[11] 4,433,232

[45] Feb. 21, 1984

[54] HEATING APPARATUS

[75] Inventors: Hajime Tachikawa, Fujisawa; Shuji Ohkawa, Yokohama, both of Japan

[73] Assignee: Hitachi Heating Appliances Co., Ltd., Chiba, Japan

[21] Appl. No.: 268,351

[22] Filed: May 29, 1981

[51] Int. Cl.[3] ..... H05B 1/02

[52] U.S. Cl. ..... 219/502; 250/339; 356/43; 219/497; 219/10.55 B

[58] Field of Search ..... 219/502, 497, 507–509, 219/494, 490, 491, 10.55 B; 250/338, 339, 341; 356/43; 374/121–125

[56] References Cited

U.S. PATENT DOCUMENTS

| | | | |
|---|---|---|---|
| 3,211,908 | 10/1965 | Leibowitz | 250/339 |
| 3,654,809 | 4/1972 | Worden et al. | 356/43 |
| 3,922,550 | 11/1975 | Crowley et al. | 250/339 |
| 4,180,722 | 12/1979 | Clewans | 219/502 |
| 4,245,148 | 1/1981 | Gisske et al. | 219/502 |
| 4,363,957 | 12/1982 | Tachikawa et al. | 219/502 |

FOREIGN PATENT DOCUMENTS

| | | | |
|---|---|---|---|
| 53-80844 | 7/1978 | Japan | 219/10.55 B |

*Primary Examiner*—M. H. Paschall

*Attorney, Agent, or Firm*—Antonelli, Terry & Wands

[57] ABSTRACT

Disclosed is a heating apparatus which is capable of heating an object to be heated placed in its heating chamber until the color of the surface of the object changes to a given extent, and in which the wavelength of light of visible spectrum range which is emitted from a light source to illuminate the surface of the object placed in the heating chamber and reflected therefrom is sensed by a color sensor to judge the degree of change in the hue of the surface of the object on the basis of the wavelength sensed by the color sensor to thereby control the heating operation on the basis of the result of judgement.

5 Claims, 13 Drawing Figures

HEATING APPARATUS

This invention relates to heating apparatus including a heat source disposed inside or outside of its heating chamber in which an object to be heated is placed so that the object can be heated until the color of its surface changes to a desired degree, and more particularly to an apparatus of the kind above described which comprises a control unit which detects the hue of the surface of an object being heated thereby automatically switching over the mode of heating so that the object can be heated properly.

In a heating apparatus such as an electric oven, a gas oven (or grill) or an oven range, hot gas or infrared radiation generated by actuation of a heat source such as an electric heater, or a gas burner is supplied into its heating chamber to heat an object to be heated placed in the heating chamber. In such a heating apparatus, means such as a timer was used for controlling the timing of completing heating of the object placed in the heating chamber, and the user determined the duration of heating by manipulating the timer to achieve the desired finish. Due to, however, the fact that the optimum duration of heating for achieving the desired finish is variable depending on the factors including the amount, water content, composition and shape of an object to be heated in the heating chamber, considerable skill was required for setting the optimum duration of heating, and improper setting of the heating duration resulted frequently in overheating or underheating of the object. An improvement which obviates the above defect has been proposed according to which a lamp emitting light of visible spectrum range illuminating an object being heated in the heating chamber is provided, and a photo sensor sensing the intensity of light reflected from the surface of the object being heated is provided to detect the degree of charring of the surface of the object on the basis of a change in the intensity of reflected light (relative brightness), so that heating by, for example, the electric heater can be stopped as soon as the surface of the object being heated is charred to the desired degree.

The prior art heating apparatus has, however, been defective in that an object to be heated under automatic control has not always been adequately heated, so that and the heating process has tended to bring about large variations in the finished state. This is because, when for example, the object is a foodstuff, and yolk, sauce or the like is coated on the surface of the object, the surface of the object being heated becomes glossy or light reflective, while when the object to be heated is contained in a pot and a transparent mating lid is put on the pot, the lid tends to reflect light.

In the prior art heating apparatus, the process of heating of an object to be heated is automatically controlled by detecting the degree of charring of the surface of the object on the basis of a change in the intensity of light reflected therefrom. Such an apparatus has also been defective in that proper heating can be hardly attained due to the presence of noise giving rise to fluctuation of the control output level when the user desires to stop heating in the condition in which there is substantially no change in the intensity of light reflected from the surface of the object being heated although the color of the surface of the object has changed, as when the object is lightly grilled.

It is therefore a primary object of the present invention to provide a novel and improved heating apparatus which obviates the prior art defects pointed out above and which can carry out the desired proper automatic control of heating of an object to be heated by detecting a change in the hue of the surface of the object being heated and switching over the heating mode so that the surface of the object can be finished to the desired condition set by the user.

In accordance with the present invention which attains the above object, there is provided a heating apparatus comprising a heating chamber, heating means capable of heating an object to be heated placed in the heating chamber to an extent that the color of a surface of the object changes, light source means for emitting light of visible spectrum range illuminating the surface of the object placed in the heating chamber, first photo sensor means for sensing the wavelength of light reflected from the surface of the object being heated, means for judging the degree of charring of the surface of the object in response to the output from the first photo sensor means, and means for controlling the heating operation of the heating means in response to the output from the judging means.

The present invention will be described in detail with reference to the accompanying drawings, in which.

Figure 2:
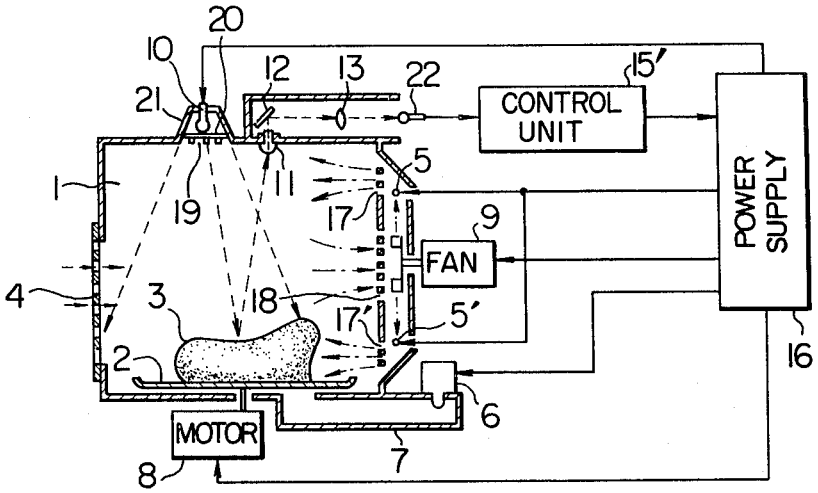
FIG. 2 shows schematically the structure of an embodiment of the heating apparatus according to the present invention.
Figure 10:
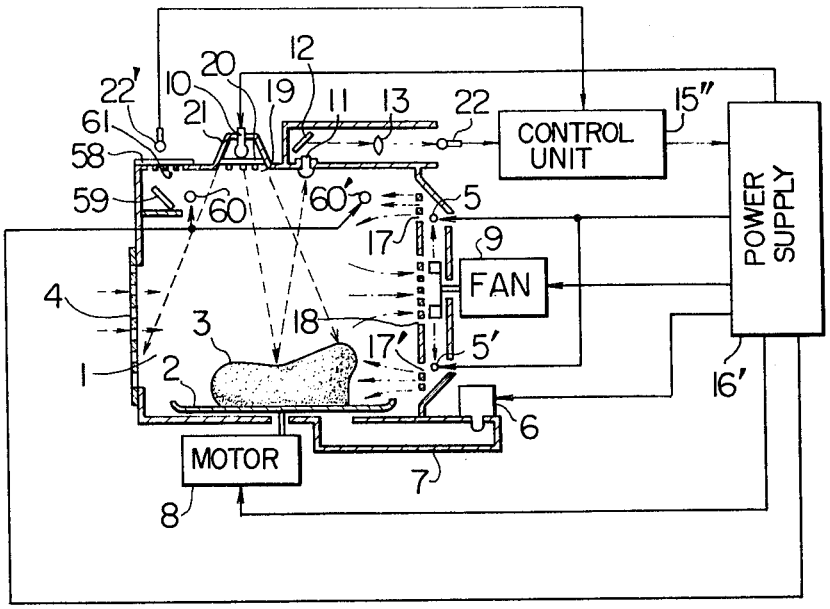
Figure 11:
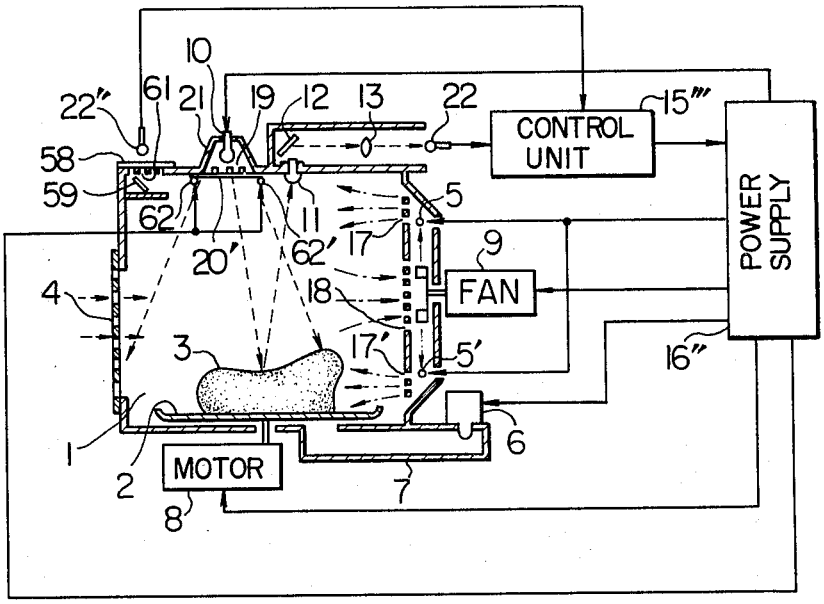
Figure 12:
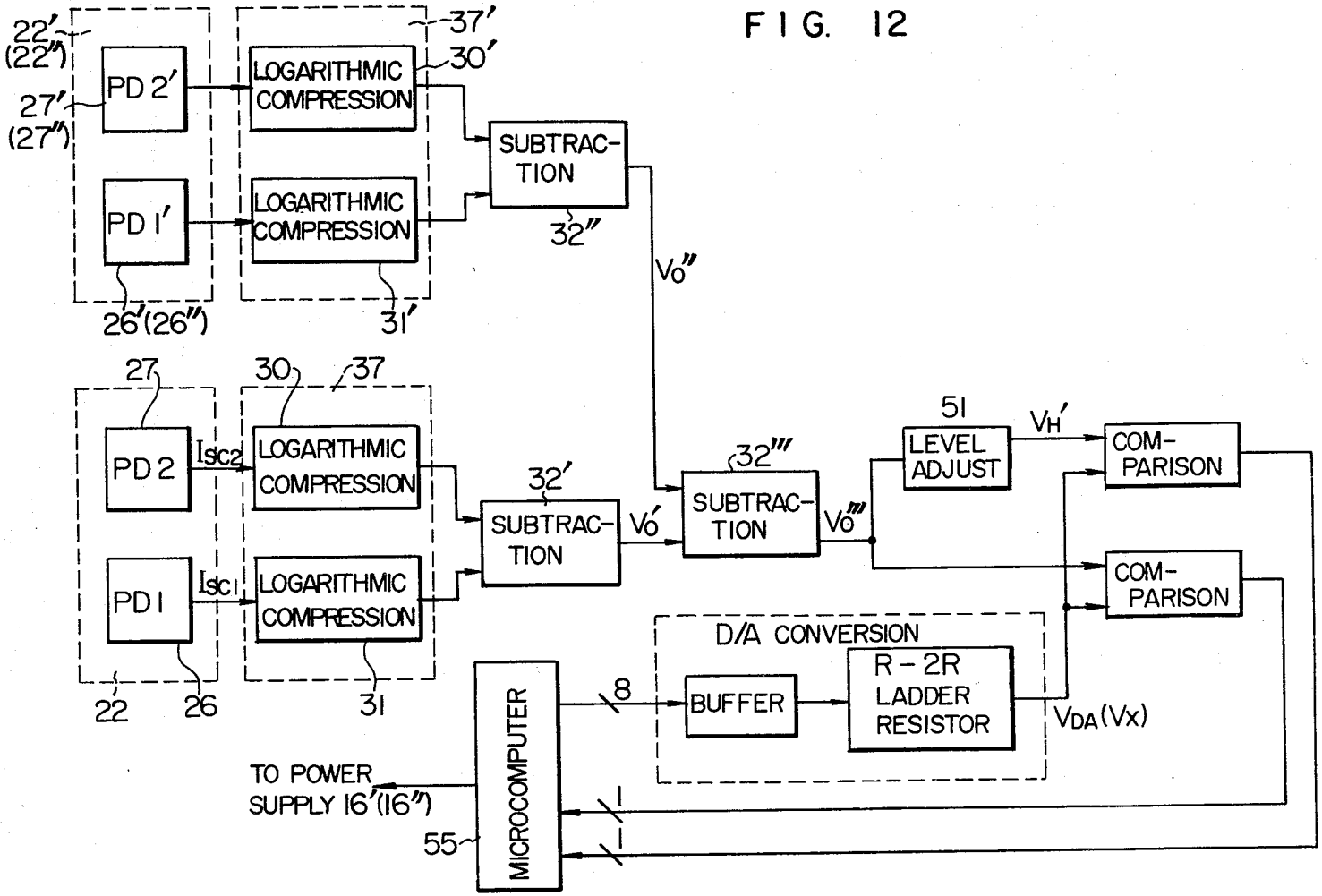

FIG: 9 is a block diagram showing the practical structure of a third form of the control unit employed in the embodiment of the present invention shown in FIG. 2;

FIG. 10 shows schematically the structure of a second embodiment of the heating apparatus according to the present invention;

FIG. 11 shows schematically the structure of a third embodiment of the heating apparatus according to the present invention; and FIG. 12 is a block diagram showing the practical structure of a fourth form of the control unit employed in the embodiments of the present invention shown in FIGS. 10 and 11.

For a better understanding of the present invention, the structure of one form of the prior art heating apparatus will be briefly described with reference to FIG. 1 before describing the present invention in detail.

Figure 1:
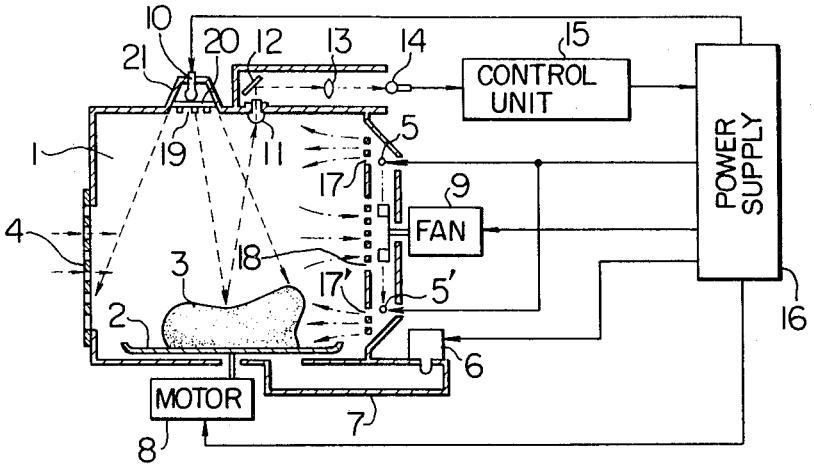
FIG. 1 PRIOR ART
FIG. 1 shows schematically the structure of one form of the prior art heating apparatus.

Referring to FIG. 1, a door 4 formed with a view window is opened, and an object 3 to be heated is placed on a turntable 2 in a heating chamber 1. When a power supply 16 is actuated after closing the door 4, a lamp 10 disposed in a lamp housing 21 is energized to emit light of visible spectrum range which is directed through a sheet 20 of heat-resistive glass and through a plurality of punchings 19 provided in the upper wall of the heating chamber 1 toward the object 3 to illuminate the same. Light reflected from the surface of the object 3 to be heated is directed toward a photo sensor or light-intensity sensor 14 through a condenser 11, a mirror 12 and a lens 13, and the signal indicative of the intensity of light reflected from the object 3 and sensed by the light-intensity sensor 14 is applied from the light-intensity sensor 14 to a control unit 15. In the meantime, electric heaters 5, 5' and a fan 9 start to operate to supply hot air into the heating chamber 1 through inlet perforations 17 and 17'. The stream of hot air is then discharged through outlet perforations 18 to be recirculated. The object 3 placed on the turntable 2 in the heating chamber 1 is heated by such a circulating stream of hot air. A motor 8 for turning the turntable 2 is energized at the same time to prevent non-uniform heating of the object 3. As the surface of the object 3 is progressively charred by the heat provided by hot air, the intensity of reflected light sensed by the light-intensity sensor 14 is gradually lowered. When the intensity of reflected light sensed by the light-intensity sensor 14 attains a predetermined setting, the control unit 15 applies a switch-over signal to the power supply 16. In response to the application of this switch-over signal to the power supply 16, the electric heaters 5, 5', fan 9, motor 8 and lamp 10 are deenergized to complete heating of the object 3.

The heating apparatus shown in FIG. 1 includes a high-frequency or microwave oscillating tube 6 and a waveguide 7 known in the art. In FIG. 1, the beams of light are indicated by the broken lines, and the streams of hot air are indicated by the one-dot chain lines. Although not shown in FIG. 1 to avoid complexity of illustration, a temperature sensor is provided to control the temperature of hot air. In response to the application of the output signal from the temperature sensor, the control unit 15 controls the electric heaters 5 and 5' through the power supply 16 so as to maintain the temperature of hot air at a predetermined setting. However, the prior art heating apparatus shown in FIG. 1 has been defective as pointed out already.

Preferred embodiments of the present invention which obviates the prior art defects will now be described in detail.

FIG. 2 is a schematic sectional view of an embodiment of the heating apparatus of the present invention which includes a color sensor 22 for sensing the wavelength (color) of light reflected from the surface of an object 3 to be heated. In FIG. 2, the same reference numerals are used to designate the same parts appearing in FIG. 1.

Referring to FIG. 2, the color sensor 22 senses the wavelength of light reflected from the surface of the object 3 to be heated. When now the door 4 is opened, the object 3 to be heated is placed on the turntable 2 in the heating chamber 1, and, after closing the door 4, the power supply 16 is energized, the lamp 10 is energized to emit light of visible spectrum range illuminating the surface of the object 3 to be heated. Light reflected from the surface of the object 3 is directed toward the color sensor 22 through the condensor 11, mirror 12 and lens 13, and the color sensor 22 applies its output signal indicative of the wavelength of reflected light to a control unit 15'. The control unit 15' stores the wavelength signal (the signal indicative of the wavelength of light reflected from the surface of the object 3) applied from the color sensor 22 to utilize it for the control of the power supply 16. In the meantime, the electric heaters 5, 5' and the fan 9 start to operate to supply hot air into the heating chamber 1 through the inlet perforations 17 and 17'. The stream of hot air is then discharged through the outlet perforations 18 to be recirculated, so that the object 3 placed on the turntable 2 in the heating chamber 1 is heated by the circulating stream of hot air. The motor 8 for driving the turntable 2 is energized at the same time to prevent non-uniform heating of the object 3.

As the surface of the object 3 is progressively dried and then charred, the wavelength of reflected light sensed by the color sensor 22 varies correspondingly. The wavelength of reflected light shifts toward the longer wavelength range or red portion of the spectrum with progressive charring of the surface of the object 3 being heated. When the wavelength of reflected light sensed by the color sensor 22 attains a predetermined setting, the control unit 15' applies a switch-over signal to the power supply 16. In response to the application of this switch-over signal to the power supply 16, the electric heaters 5, 5' and the fan 9 are deenergized, and the high-frequency or microwave energy.

It is required that the condenser 11 including its mounting portions is so dimensioned as to prevent or cut off leakage of the microwave energy therethrough. The function of the condenser 11 is to permit detection of the hue of the surface of the object 3 being heated while, at the same time, protecting the color sensor 22 against the heat provided by hot air. The function of the optical system composed of the condenser 11, mirror 12 and lens 13 is to minimize the adverse effect of the temperature on the color sensor 22 and to permit adjustment of the light receiving area of the color sensor 22 by suitably adjusting the position of the lens 13. Better control performance will be obtained when the color sensor 22 is arranged to be cooled by cooling air.

Figure 3A:
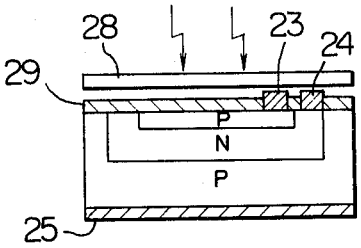
FIG. 3A shows the structure of the color sensor employed in the present invention and FIG. 3B the equivalent circuit of the color sensor.
Figure 3B:
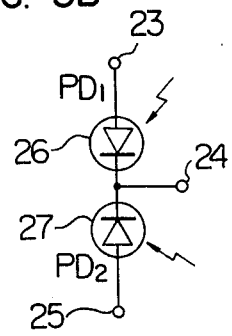
Figure 4:
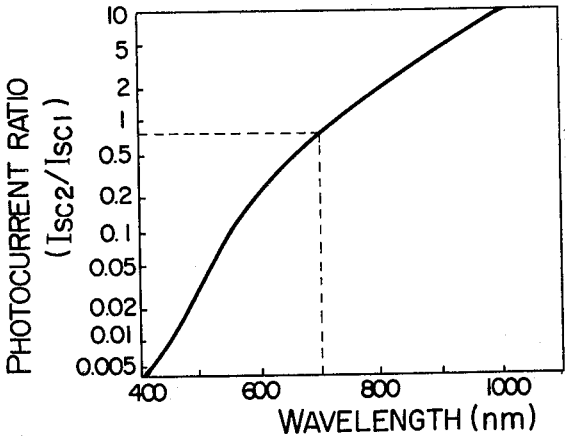
FIG. 4 is a graph showing the relation between the wavelength and the photocurrent output ratio in the color sensor shown in FIGS. 3A and 3B.

FIG. 3A shows the structure of the color sensor 22 shown in FIG. 2, and FIG. 3B shows the equivalent circuit of the color sensor 22. In FIGS. 3A and 3B, the reference numerals 23, 24, 25, 26, 27, 28 and 29 designate a first electrode, a second electrode, a third electrode, a first photodiode $PD_1$, a second photodiode $PD_2$, an infrared cut-off filter and an electrical insulating film, respectively. It will be seen in FIGS. 3A and 3B that the color sensor 22 includes two photodiodes $PD_1$ and $PD_2$ of longitudinal structure formed in a single substrate of silicon, and the thickness of silicon (the photodiode $PD_1$) itself is utilized as an optical filter. More precisely, the color sensor 22 of illustrated structure exhibits such a spectral sensitivity that the first photodiode $PD_1$ formed by the shallower PN junction exhibit high sensitivity to short wavelengths, while the second photodiode $PD_2$ formed by the deeper PN junction exhibits high sensitivity to long wavelengths. This is because light of short wavelengths is absorbed by the shallower portion in the vicinity of the surface of the silicon substrate, while light of long wavelengths is absorbed by the deeper portion of the silicon substrate. FIG. 4 is a graph showing the relation between the wavelength and the photocurrent output ratio $I_{SC}$.

$_2/I_{SC1}$ between the photocurrent output $I_{SC2}$ of the second photo diode $PD_2$ and that $I_{SC1}$ of the first photo diode $PD_1$. It will be seen in FIG. 4 that there is one-to-one correspondence between the photocurrent output ratio and the wavelength.

Figure 5:
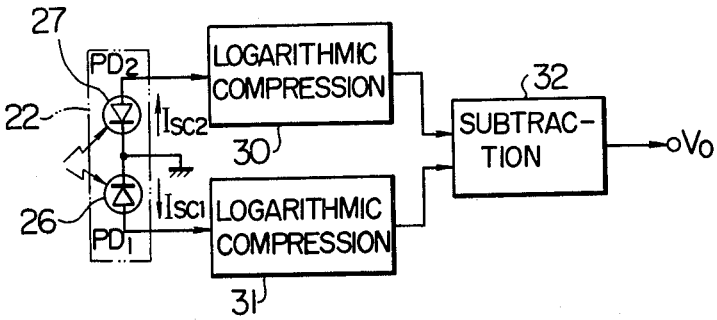
FIG. 5 is a block diagram showing the structure of a basic processing system including the color sensor shown in FIGS. 3A and 3B.

FIG. 5 is a block diagram showing the structure of a basic processing system including the color sensor 22 shown in FIG. 3. Referring to FIG. 5, the photocurrent outputs $I_{SC1}$ and $I_{SC2}$ from the photodiodes 26 ($PD_1$) and 27 ($PD_2$) are subject to logarithmic compression in logarithmic compressors 31 and 30 respectively, and the output signal from the logarithmic compressor 31 is subtracted from the output signal from the logarithmic compressor 30 in a subtractor 32. The output voltage $V_O$ from the subtractor 32 is expressed as follows:

$$V_O \propto \log I_{SC2} - \log I_{SC1} = \log (I_{SC2}/I_{SC1})$$

Since the value of the ratio $I_{SC2}/I_{SC1}$ is kept constant independently of a variation of the intensity of light incident upon the color sensor 22, the output voltage $V_O$ from the subtractor 32 is not also affected by the intensity of incident light. This proves the fact that the S/N ratio of the signal indicative of sensed wavelength is not adversely affected by a variation of the intensity of light emitted from the lamp 10, a variation of the intensity of external light entering the heating chamber 1 through the finder of the door 4, the glossiness of the surface of the object 3 being heated when sauce or the like is coated on the surface, and the intensity of light reflected from a lid covering a pot which contains the object 3 when such a pot is used.

The wavelength sensed by the color sensor 22 is not necessarily the same as that recognized by the eyes of the user. Suppose that light including a plurality of wavelengths, for example, a wavelength of 500 nm with an intensity of 5 mW/cm$^2$ and a wavelength of 800 nm with an intensity of 3 mW/cm$^2$, is reflected from the surface of the object 3 being heated and is incident upon the color sensor 22. Then, the wavelength will be recognized to be about 500 nm by the eyes of the user, while it will be recognized to be 510 nm by the color sensor 22.

Figure 6:
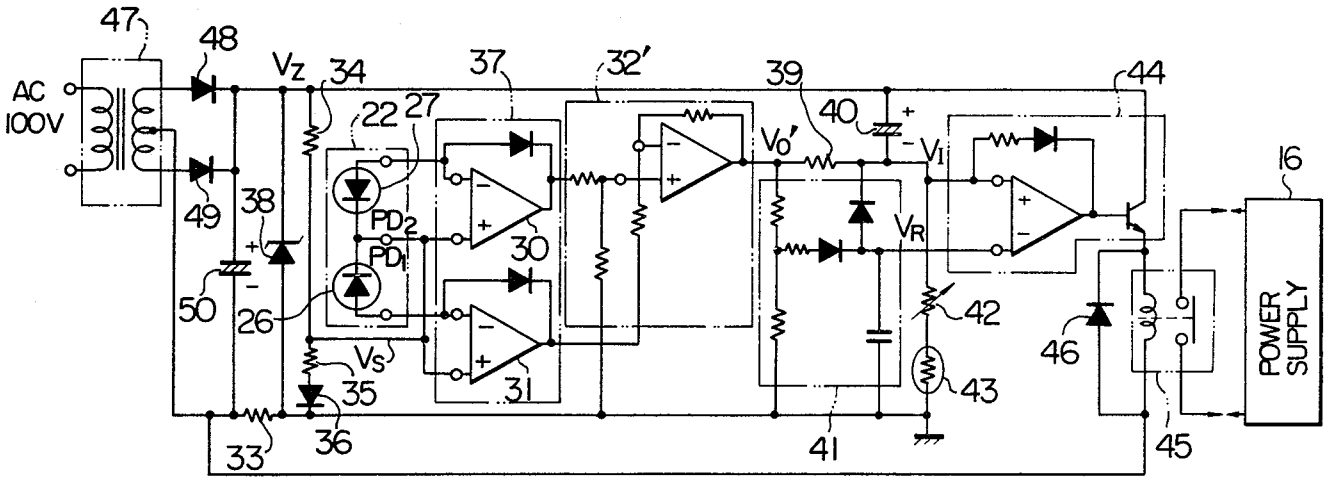
FIG. 6 is a circuit diagram showing the practical structure of one form of the control unit employed in the embodiment of the present invention shown in FIG. 2.

FIG. 6 is a circuit diagram showing the practical structure of one form of the control unit 15' employed in the embodiment of the heating apparatus of the present invention shown in FIG. 2. In FIG. 6, the same reference numerals are used to designate the same parts appearing in FIGS. 2, 3 and 5.

Referring to FIG. 6, an AC voltage of 100 volts is applied across the primary winding of a transformer 47 to induce a transformed AC voltage across the secondary winding of the transformer 47. This secondary voltage is then rectified by diodes 48, 49 and smoothed by a capacitor 50, and the DC voltage thus obtained is applied across a Zener diode 38 and a resistor 33. A stabilized voltage $V_Z$ appears across the Zener diode 38.

Photocurrent outputs $I_{SC1}$ and $I_{SC2}$ proportional to the intensity of light reflected from the surface of the object 3 being heated appear from the photo diodes 26 ($PD_1$) and 27 ($PD_2$) of the color sensor 22 and are applied to the logarithmic compressors 31 and 30 respectively which constitute a logarithmic amplifier 37 together with associated diodes. The logarithmic compressors 31 and 30 in the logarithmic amplifier 37 convert the respective photocurrent inputs $I_{SC1}$ and $I_{SC2}$ into logarithmically compressed voltages which are applied to the subtractor which is constituted in the form of a differential amplifier 32' as shown in FIG. 6. The positive input terminals of the logarithmic compressors 30 and 31 constituting the logarithmic amplifier 37 are biased by a voltage $V_S$ obtained by dividing the stabilized voltage $V_Z$ by resistors 34, 35 and a diode 36. One of the input voltages is subtracted from the other in the differential amplifier 32', and the difference therebetween is amplified to appear as an output voltage $V_O'$. It is to be noted, however, that the subtraction carried out in the differential amplifier 32' in FIG. 6 is inverse to the subtraction carried out in the subtractor 32 in FIG. 5, and, in this case, the output voltage $V_O'$ is given by $V_O' \propto \log (I_{SC1}/I_{SC2})$. As described with reference to FIG. 5, this output voltage $V_O'$ has a 1:1 correspondence with the wavelength of light reflected from the surface of the object 3 being heated. In the structure shown in FIG. 6, the longer the wavelength, that is, the nearer to the wavelength of the red portion of the spectrum, the output voltage $V_O'$ is lower.

This output voltage $V_O'$ from the differential amplifier 32' is then divided by a resistor 39, a potentiometer 42 and a temperature-compensating thermistor 43 to provide a divided voltage $V_I$ which is applied to one of the input terminals or the positive input terminal of a comparator 44 of self-holding type. A capacitor 40 acts as a filter. The level of the voltage $V_O'$ is shifted down by a capacitor memory circuit 41, and such a voltage level $V_R$ is stored in the circuit 41. It is to be noted, however, that the rate of shifting-down of the voltage $V_O'$ relative to the voltage $V_I$ is necessarily selected to satisfy the relation $V_I > V_R$ in the starting stage of heating. The voltage $V_R$ stored in the capacitor memory circuit 41 is applied to the other or negative input terminal of the comparator 44. The comparator 44 compares the two input voltages $V_I$ and $V_R$ and supplies current to the primary coil of a relay 45 when the result of comparison proves that $V_I > V_R$, while it ceases to supply current when the result of comparison proves that $V_I < V_R$. Further, the comparator 44 is so constructed that, when the relation $V_I < V_R$ appears, it acts to lower the voltage $V_I$ so as to hold the relation $V_I < V_R$. In response to the supply of current from the comparator 44 to the primary coil of the relay 45, the secondary contact of the relay 45 connected to the power supply 16 is turned on. In response to the closure of this secondary contact of the relay 45, the power supply 16 is actuated to carry out heating of the object 3 by the hot air as described with reference to FIG. 2. On the other hand, in response to the opening of the secondary contact of the relay 45, the power supply 16 is deactuated to cease heating by the hot air, so that the high-frequency or microwave heating of the object 3 can be carried out thereafter for the pre-set period of time. A diode 46 is connected in parallel with the primary coil of the relay 45 to prevent flow of current into the primary coil of the relay 45 when the comparator 44 ceases to supply its current output.

In operation, the door 4 is opened, and an object 3 to be heated is placed on the turntable 2 in the heating chamber 1. After closing the door 4, a start button (not shown) on the control panel is depressed or turned on to apply the AC voltage of 100 volts across the primary winding of the transformer 47. Consequently, the DC voltage is applied across the capacitor 50, and the stabilized voltage $V_Z$ appears across the Zener diode 38. Due to the fact that the capacitor 40 and the capacitor in the capacitor memory circuit 41 are short-circuited in the AC sense at this time, the relation between the voltages $V_I$ and $V_R$ is now given by $V_I > V_R$, and the comparator 44 supplies current to the primary coil of the relay 45. Consequently, the secondary contact of the relay 45 is turned on to actuate the power supply 16, and the lamp 10 is energized to emit light of visible spectrum range illuminating the object 3 to be heated. Also, the fan 9, the electric heaters 5, 5', and the drive motor 8 for the turntable 2 start to operate. The color sensor 22 senses the wavelength of light reflected from the surface of the object 3 being heated, and the output voltage $V_O'$ indicative of the sensed wavelength appears from the differential amplifier 32'. The voltage $V_R$ obtained by shifting down the level of the voltage $V_O'$ is applied from the capacitor memory circuit 41 to the comparator 44 to maintain the relation $V_I > V_R$, and the comparator 44 continues to supply current to the primary coil of the relay 45.

As the surface of the object 3 being heated is progressively dried and charred, the wavelength of light reflected from the surface of the object 3 being heated shifts progressively toward the red portion of the spectrum. Consequently, the output voltage $V_O'$ from the differential amplifier 32' is gradually lowered, and the voltage $V_R$ corresponding to the lowered level of the voltage $V_O'$ is stored in the capacitor in the capacitor memory circuit 41. With further progress of heating, the level of the voltage $V_O'$ is lowered further, and the level of the voltage $V_I$ is also lowered to gradually approach the level of the voltage $V_R$. When finally the relation $V_I < V_R$ holds, the comparator 44 ceases to supply current to the primary coil of the relay 45. Consequently, the secondary contact of the relay 45 is turned off, and the mode of heating with the hot air is switched over to the mode of heating with the microwave energy. The latter heating mode is completed upon lapse of the pre-set period of time. The lamp 10 and motor 8 are also deenergized. Although not shown in FIG. 6, a second secondary contact of the relay 45 is connected in parallel with the contact of the aforementioned start button on the control panel. In response to the depression of the start button by the user, this second secondary contact of the relay 45 is turned on in a manner as described in relation to the closure of the first secondary contact, so that, even after the user releases application of depressing pressure to the start button, the AC voltage of 100 volts can be continuously applied across the primary winding of the transformer 47. Upon completion of heating of the object 3, the second secondary contact of the relay 45 is turned off to release application of the AC voltage of 100 volts across the primary winding of the transformer 47. It can thus be seen that the process of heating of the object 3 to be heated can be automatically controlled by the color sensor 22 sensing the wavelength of light reflected from the surface of the object 3 being heated.

Figure 7:
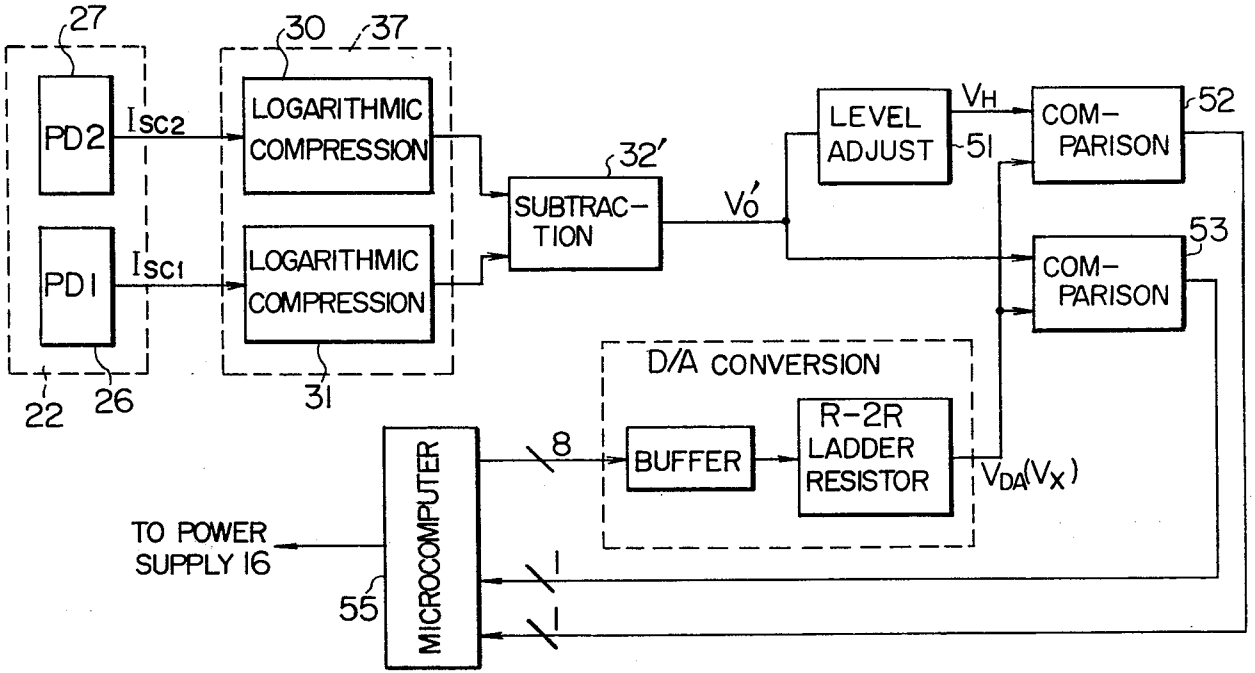
FIG. 7 is a block diagram showing the practical structure of a second form of the control unit employed in the embodiment of the present invention shown in FIG. 2.
Figure 8:
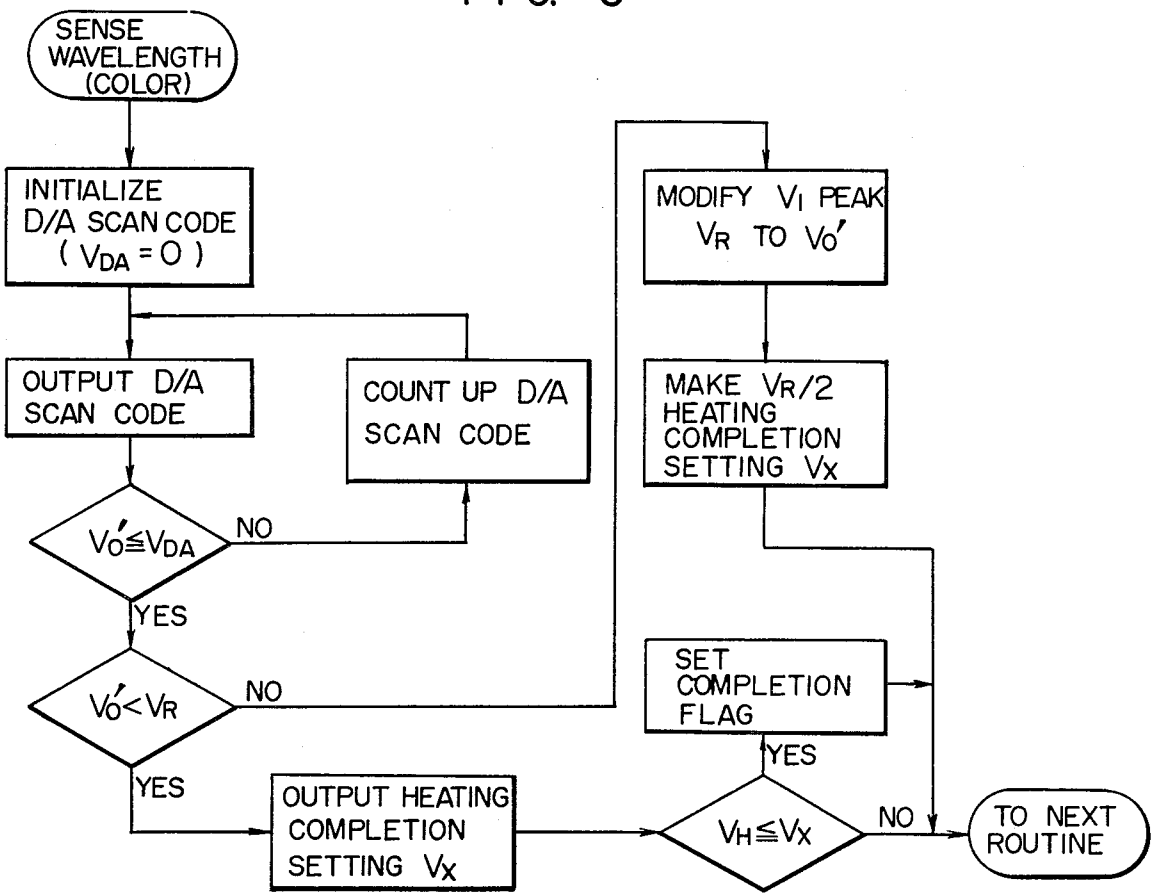
FIG. 8 is a general flow chart showing the steps of hue detection through processing by the microcomputer shown in FIG. 7.

FIG. 7 is a block diagram showing the practical structure of a second form of the control unit 15' shown in FIG. 2, and FIG. 8 is a general flow chart of the steps carried out by the control unit 15' of the structure shown in FIG. 7. The control unit 15' of the structure shown in FIG. 7 includes a microcomputer 55, and, although there are many input and output blocks except those shown in FIG. 7, those related directly with the automatic control of the heating operation on the basis of the sensed wavelength of light reflected from the surface of an object 3 being heated are only shown to avoid confusion. In FIG. 7, the same reference numerals are used to designate the same parts appearing in FIG. 6.

Referring to FIG. 7, the output signals or photocurrent outputs $I_{SC1}$ and $I_{SC2}$ from the photodiodes 26 and 27 in the color sensor 22 are applied to the respective logarithmic compressors 31 and 30 constituting the logarithmic amplifier 37 in which the input signals are converted into the logarithmically compressed voltages. The output signals from the logarithmic amplifier 37 are applied to the subtractor 32' in which the output signal from the logarithmic compressor 30 is substracted from the output signal from the logarithmic compressor 31 to provide the output voltage $V_O'$ indicative of the result of subtraction. This output voltage $V_O'$ is applied from the subtractor 32' to a level adjuster 51 and to a comparator 53. The level adjuster 51 adjusts the input voltage $V_O'$ at the level desired by the user and applies the resultant signal voltage $V_H$ to another comparator 52.

On the other hand, the microcomputer 55 applies an 8-bit code to a D/A converter 54 so as to read the voltages $V_O'$ and $V_H$. The D/A converter 54 includes a buffer and an R-2R ladder resistor and provides an analog output voltage $V_{DA}$ or $V_X$ which is applied to the comparators 52 and 53. The comparator 52 compares the voltage $V_H$ with the voltage $V_X$, and a 1-bit signal indicative of the result of comparison is applied from the comparator 52 to the microcomputer 55. Similarly, the comparator 53 compares the voltage $V_O'$ with the voltage $V_{DA}$, and a 1-bit signal indicative of the result of comparison is applied from the comparator 53 to the microcomputer 55. In this manner, the microcomputer 55 applies sequentially an 8-bit code providing an analog voltage $V_{DA}$ or $V_X$ which is compared with the voltages $V_O'$ and $V_H$ so as to read the approximate values of the voltages $V_O'$ and $V_H$. The application of the 8-bit code continues until the peak value of the voltage $V_O'$, hence, the voltage $V_R$ is detected. By carrying out necessary calculation using this voltage $V_R$, the microcomputer 55 determines the reference value of the voltage $V_X$ which indicates the end of heating. Then, the voltage $V_H$ is compared with the reference voltage $V_X$ until the level of the voltage $V_H$ attains substantially the level of the reference voltage $V_X$, and, at the time at which the voltage $V_H$ attains substantially the reference voltage $V_X$, the microcomputer 55 applies the switch-over signal to the power supply 16 so that the mode of heating with the hot air can be switched over to the mode of heating with the microwave energy.

The general flow chart of FIG. 8 showing the steps of automatic control of the heating operation by sensing the wavelength of light reflected from the surface of the object 3 being heated clarifies the operation of the microcomputer 55. In the first step, the D/A scan setting is initialized. That is, an 8-bit code indicative of zero volts is applied from the microcomputer 55 to the D/A converter 54 to provide the voltage $V_{DA}$ of zero volts. Then, the output signal from the comparator 53 is read, and the 8-bit code providing the voltage $V_{DA}$ is sequentially counted up until the relation $V_O' \leqq V_{DA}$ is obtained. When the relation $V_O' \leqq V_{DA}$ is thus obtained, the 8-bit code providing the voltage $V_{DA}$ satisfying the above relation is compared with the 8-bit code having been applied to provide the peak voltage $V_R$ before attainment of the relation $V_O' \leqq V_{DA}$. When the result of comparison proves that $V_O' \leqq V_R$, the code providing such a voltage $V_R$ is modified into the code providing the voltage $V_O'$, and the code providing the new value of the voltage $V_O'$ is shifted by one bit position toward the right to obtain the code providing the value $V_R/2$ so as to use it as the code providing the heating completion setting $V_X$. When, on the other hand, the result of comparison proves that $V_O' < V_R$, the code providing the voltage $V_X$ is applied to the D/A converter 54. Then, the output signal from the comparator 52 is read, and the heating completion flag indicating the completion of the mode of heating with hot air is set as soon as the relation $V_H \leqq V_X$ is established. In another processing routine, the setting of this flag is checked or confirmed so as to apply the switch-over signal to the power supply 16. It can be seen that employment of the circuit structure shown in FIG. 7 can also successfully attain the automatic control of the heating operation.

Figure 9:
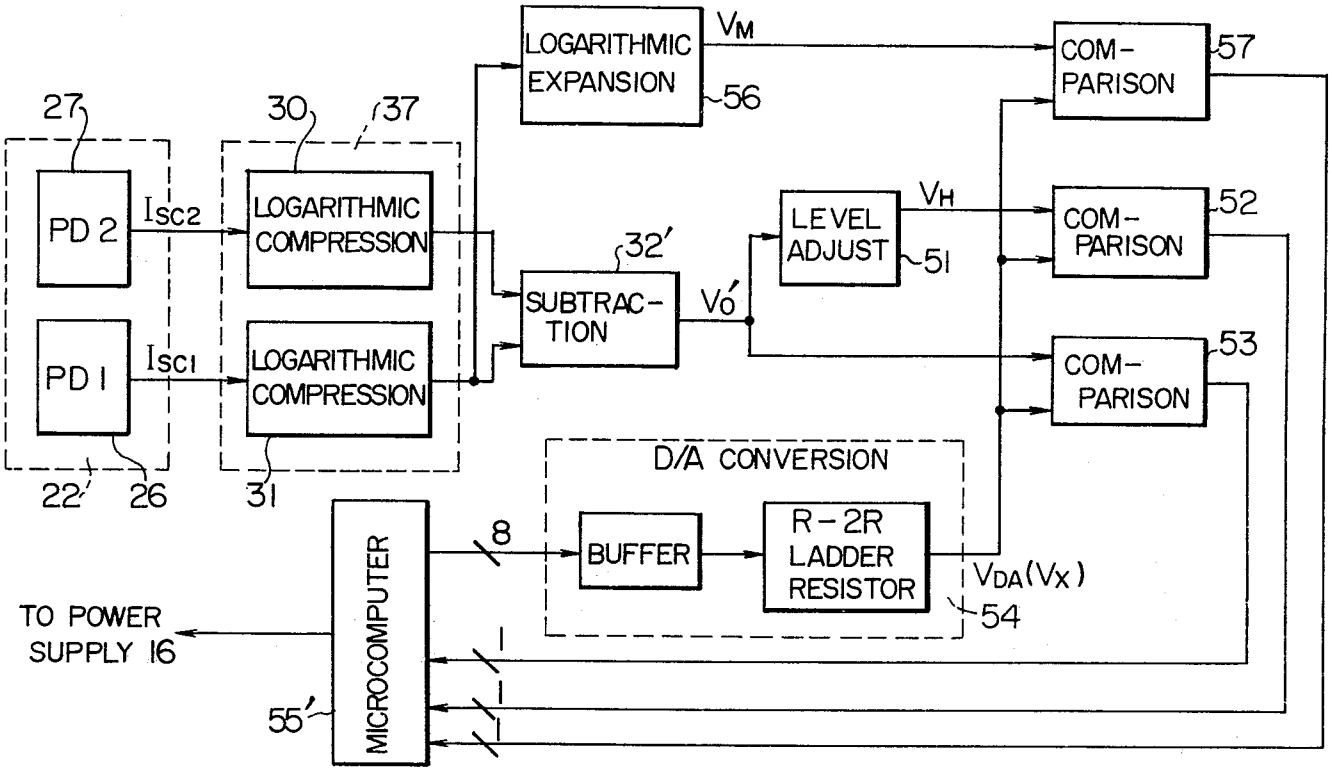

FIG. 9 is a block diagram showing the practical structure of a third form of the control unit 15' shown in FIG. 2. In FIG. 9, the same reference numerals are used to designate the same parts appearing in FIG. 7. The reference numerals 56 and 57 designates a logarithmic expander and an additional comparator respectively. The vision of a person depends on the color which differs depending on the wavelength of light as well as the relative brightness which is dependent upon the intensity of light reflected from an object. During heating of an object 3 to be heated (for example, a foodstuff), the wavelength of light reflected from the surface of the object 3 being heated shifts toward longer wavelengths (the red portion of the spectrum) as the surface of the object 3 is progressively dried and charred, while the intensity of light reflected from the surface of the object 3 being heated is progressively lowered (that is, the surface is progressively darkened). In the form of the control unit 15' shown in FIG. 9, the light intensity signal is considered together with the wavelength signal obtained by the color sensor 22 so that the heating operation can be automatically controlled by an arrangement which simulates the vision of a person.

Referring to FIG. 9, the photocurrent outputs $I_{SC1}$ and $I_{SC2}$ from the photodiodes 26 and 27 in the color sensor 22 are applied to the logarithmic compressors 31 and 30 respectively constituting the logarithmic amplifier 37 to be converted into logarithmically compressed voltages. The output signal from the logarithmic compressor 30 is subtracted in the subtractor 32' from the output signal from the logarithmic compressor 31 to provide an output voltage $V_O'$ from the substractor 32'. The output signal from the logarithmic compressor 31 connected to the photodiode 26 is also applied to the logarithmic expander 56 in which the input signal is logarithmically expanded to provide a signal voltage $V_M$ linearly proportional to the photocurrent $I_{SC1}$, and such a signal voltage $V_M$ is applied to the comparator 57. The output voltage from the subtractor 32' is applied to the level adjuster 51 and to the comparator 53. The level adjuster 51 adjusts the voltage $V_O'$ at the level desired by the user and applies the resultant signal voltage $V_H$ to the comparator 52.

On the other hand, a microcomputer 55' applies an 8-bit code to the D/A converter 54 to read the voltages $V_O'$, $V_H$ and $V_M$. The D/A converter 54 including the buffer and the R-2R ladder resistor provides an analog output voltage $V_{DA}$ or $V_X$ which is applied to the comparators 52, 53 and 57. The comparator 52 compares the voltage $V_H$ with the voltage $V_X$, and a 1-bit signal indicative of the result of comparison is applied from the comparator 52 to the microcomputer 55'. Similarly, the comparator 53 compares the voltage $V_O'$ with the voltage $V_{DA}$, and a 1-bit signal indicative of the result of comparison is applied from the comparator 53 to the microcomputer 55'. Also, the comparator 57 compares the voltage $V_M$ with the voltage $V_{DA}$, and a 1-bit signal indicative of the result of comparison is similarly applied from the comparator 57 to the microcomputer 55'. In this manner, the microcomputer 55' applies sequentially an 8-bit code providing an analog voltage $V_{DA}$ or $V_X$ which is compared with the voltages $V_O'$, $V_H$ and $V_M$ so as to read the approximate values of the voltages $V_O'$, $V_H$ and $V_M$. The application of the 8-bit code continues until the peak value of the voltage $V_O'$, hence, the voltage $V_R$ is detected. By carrying out necessary calculation on the basis of this voltage $V_R$ and the value of the voltage $V_M$ detected at that time, the microcomputer 55' determines the reference value of the voltage $V_X$ ($=V_R \cdot V_M/2$) which indicates the end of heating. Then, the voltage $V_H \cdot V_M$ is compared with the reference voltage $V_X$ until the level of the former attains substantially the level of the latter, and, at the time at which the former attains substantially the latter, the microcomputer 55' applies the switch-over signal to the power supply 16 so that the mode of heating with the hot air is switched over to the mode of heating with the microwave energy.

Employment of the circuit structure shown in FIG. 9 can also attain the automatic control of heating of an object 3 to be heated. In the form of the control unit 15' shown in FIG. 9, both the wavelength and the intensity of light reflected from the surface of the object 3 being heated are sensed for attainment of the automatic control on the basis of the sensed wavelength and light intensity. Therefore, a change in the surface state of the object 3 due to heating can be detected in a similar manner to the vision of a person.

FIG. 10 is a schematic sectional view showing the structure of a second embodiment of the heating apparatus of the present invention which includes a second color sensor 22' for sensing the wavelength of radiation generated from electric heaters 60 and 60' provided for heating an object 3 by radiant heat. In FIG. 10, the same reference numerals are used to designate the same parts appearing in FIG. 2.

When now the door 4 is opened, the object 3 to be heated is placed on the turntable 2 in the heating chamber 1, and, after closing the door 4, the power supply 16 is energized, the lamp 10 is energized to emit light of visible spectrum range illuminating the object 3 to be heated. Light reflected from the surface of the object 3 is directed toward the first color sensor 22 through the condenser 11, mirror 12 and lens 13, and the second color sensor 22' applies its output signal indicative of the wavelength of reflected light to a control unit 15''. The second color sensor 22' senses the wavelength of radiation generated from the electric heaters 60, 60' and incident thereupon through a mirror 59, a plurality of punchings 61 provided in the upper wall of the heating chamber 1 and a sheet 58 of heat-resistive glass, and applies its output signal indicative of the wavelength of radiation generated from the electric heaters 60 and 60' to the control unit 15''. While compensating a variation of the wavelength of radiation from the electric heaters 60 and 60' on the basis of the output signal from the second color sensor 22', the control unit 15'' stores the wavelength signal (the signal indicative of the wavelength of light reflected from the surface of the object 3) applied from the first color sensor 22 to utilize it for the control of a power supply 16'. It is necessary to compensate a variation of the wavelength of radiation generated from the electric heaters 60 and 60' on the basis of the output signal from the second color sensor 22', because a variation of, for example, the power supply voltage applied across the electric heaters 60 and 60' results in a variation of heat radiated therefrom, and the corresponding variation of the wavelength of radiation results also in a corresponding variation of the wavelength of light reflected from the surface of the object 3. In the meantime, the electric heaters 5, 5' in addition to the heaters 60, 60' start to operate to supply hot air into the heating chamber 1 through the inlet perforations 17 and 17'. The stream of hot air is then discharged through the outlet perforations 18 to be recirculated. The object 3 placed on the turntable 2 in the heating chamber 1 is heated by such a circulating stream of hot air and by the heat radiated from the electric heaters 60 and 60'. The motor 8 for turning the turntable 2 is energized at the same time to prevent non-uniform heating of the object 3. As the surface of the object 3 is progressively dried and then charred, the wavelength of reflected light sensed by the first color sensor 22 varies correspondingly and shifts toward the longer wavelength range or red portion of the spectrum with progressive charring of the surface of the object 3 being heated. When the wavelength of reflected light attains the predetermined setting, the control unit 15'' applies the switch-over signal to the power supply 16'. In response to the application of this switch-over signal to the power supply 16', the electric heaters 5, 5', 60, 60' and the fan 9 are deenergized, and the high-frequency or microwave oscillating tube 6 is energized in turn. The high-frequency or microwave energy generated from the microwave oscillating tube 6 is supplied into the heating chamber 1 by way of the waveguide 7 to heat the object 3 placed on the turntable 2 in the heating chamber 1. Upon lapse of the pre-set period of time, the power supply 16' acts to deenergize the microwave oscillating tube 6, motor 8 and lamp 10, thereby completing heating of the object 3 by the microwave energy. The electric heaters 5 and 5' are disposed behind the inlet perforations 17 and 17', and their temperature is controlled by a temperature controller (not shown) so that they do not become red hot and do not radiate red rays. However, the electric heaters 60 and 60' provided for heating the object 3 by the radiant heat radiate red rays. In the second embodiment of the heating apparatus of the present invention, it is the function of the second color sensor 22' to compensate the output signal from the first color sensor 22 thereby obviating the adverse effect of the red rays radiated from the electric heaters 60 and 60'.

FIG. 11 is a schematic sectional view of a third embodiment of the heating apparatus of the present invention in which a second color sensor 22'' is provided for sensing the wavelength of radiation generated from electric heaters 62 and 62' provided for burning away foul matters deposited on a sheet 20' of heat-resistive glass disposed in the path of light from a lamp 10 to an object 3 to be heated. In FIG. 11, the same reference numerals are used to designate the same parts appearing in FIG. 10. Although such foul-matters burning-away electric heaters 62 and 62' are also disposed adjacent to the condenser 11, those disposed adjacent to the sheet 20' of heat-resistive glass are only shown to avoid complexity of illustration.

When now the door 4 is opened, the object 3 to be heated is placed on the turntable 2 in the heating chamber 1, and, after closing the door 4, the power supply 16'' is actuated, the lamp 10 is energized to emit light of visible spectrum range illuminating the object 3 to be heated. Light reflected from the surface of the object 3 is directed toward the first color sensor 22 through the condenser 11, mirror 12 and lens 13, and the color sensor 22 applies its output signal indicative of the wavelength of reflected light to a control unit 15'''. The second color sensor 22'' senses, through the mirror 59, the punchings 61 provided in the upper wall of the heating chamber 1 and the sheet 58 of heat-resistive glass, the wavelength of radiation generated from the electric heaters 62 and 62' provided for burning away foul matters scattered from the object 3 toward and onto the glass sheet 20' and condenser 11 and applies its output signal indicative of the wavelength of radiation generated from the electric heaters 62 and 62' to the control unit 15'''. While compensating a variation of the wavelength of radiation from the electric heaters 62 and 62' on the basis of the output signal from the second color sensor 22'', the control unit 15''' stores the wavelength signal (the signal indicative of the wavelength of light reflected from the surface of the object 3) applied from the first color sensor 22 to utilize it for the control of a power supply 16''. The power supply voltage is applied to the electric heaters 62 and 62' for a predetermined short period of time in timed relation with energization of the lamp 10, and the electric heaters 62 and 62' heat the surfaces of the glass sheet 20' and condenser 11 to burn away foul matters deposited on those surfaces. As in the case of FIG. 10, it is necessary to compensate a variation of the wavelength of radiation generated from the electric heaters 62 and 62' on the basis of the output signal from the second color sensor 22'', because a variation of, for example, the power supply voltage applied across the electric heaters 62 and 62' results in a variation of heat radiated therefrom. Further, because of the fact that the rate of lowering of heat radiated from the electric heaters 62 and 62' after the energization for the predetermined short period of time is variable depending on the internal temperature of the heating chamber 1, the wavelength of light reflected from the surface of the object 3 being heated is also subject to the corresponding variation. The operation carried out thereafter is generally similar to that described with reference to FIG. 10, and its detailed description will be unnecessary.

FIG. 12 is a block diagram showing the practical structure of a fourth form of the control unit employed in the present invention and illustrates its application to the heating apparatus shown in FIGS. 10 and 11. In FIG. 12, the same reference numerals are used to designate the same parts appearing in FIGS. 7, 10 and 11.

Referring to FIG. 12, the reference numeral 22' (22'') designates the second color sensor; 37', a logarithmic amplifier including logarithmic compressors 30' and 31'; and 32'', 32''', subtractors. The photocurrent outputs $I_{SC1}$ and $I_{SC2}$ from the photodiodes 26 and 27 in the first color sensor 22 are applied to the logarithmic compressors 31 and 30 respectively constituting the logarithmic amplifier 37 to be converted into logarithmically compressed voltages. The output signal from the logarithmic compressor 30 is subtracted in the subtractor 32' from the output signal from the logarithmic compressor 31 to provide an output voltage $V_O'$ which is applied to the subtractor 32'''. Similarly, the output signals from the photodiodes 26' (26'') and 27' (27'') in the second or compensating color sensor 22' (22'') are applied to the logarithmic compressors 31'and 30' respectively constituting the logarithmic amplifier 37' to be converted into logarithmically compressed voltages. The output signal from the logarithmic compressor 31' is subtracted in the subtractor 32'' from the output signal from the logarithmic compressor 30' to provide an output voltage $V_O''$ which is applied to the subtractor 32'''. The input voltage $V_O''$ is subtracted in the subtractor 32''' from the input voltage $V_O'$ to provide an output voltage $V_O'''$ which is applied to the level adjuster 51 and to the comparator 53. The voltage $V_O'''$ indicative of the difference between the outputs of the color sensors 22 and 22' (22'') has the level corresponding to the wavelength of light reflected from the object 3 and compensated on the basis of the output signal from the second color sensor 22' (22'') sensing the wavelength of radiation generated from the electric heaters 60 and 60' (62, 62'), since the red component increases in the light reflected from the object 3 being heated when red rays are radiated from the electric heaters 60 and 60' (62, 62'). The level adjuster 51 adjusts the input voltage $V_O'''$ at the level desired by the user and applies the resultant signal voltage $V_H'$ to the comparator 52.

On the other hand, the microcomputer 55 applies an 8-bit code to the D/A converter 54 so as to read the voltages $V_O'''$ and $V_H'$. The D/A converter 54 including the buffer and the R-2R ladder resistor provides an analog output voltage $V_{DA}$ or $V_X$ which is applied to the comparators 52 and 53. The comparator 52 compares the voltage $V_H'$ with the voltage $V_X$, and a 1-bit signal indicative of the result of comparison is applied from the comparator 53 to the microcomputer 55. Similarly, the comparator 53 compares the voltage $V_O'''$ with the voltage $V_{DA}$, and a 1-bit signal indicative of the result of comparison is applied from the comparator 53 to the microcomputer 55. In this manner, the microcomputer 55 applies sequentially an 8-bit code providing an analog voltage $V_{DA}$ or $V_X$ which is compared with the voltage $V_O'''$ and $V_H'$ so as to read the approximate values of the voltages $V_O'''$ and $V_H'$. The application of the 8-bit code continues until the peak value of the voltage $V_O'''$, hence, the voltage $V_R$ is detected. By carrying out necessary calculation using this voltage $V_R$, the microcomputer 55 determines the reference value of the voltage $V_X$ which indicates the end of heating. Then, the voltage $V_H'$ is compared with the reference voltage $V_X$ until the level of the voltage $V_H'$ attains substantially the level of the reference voltage $V_X$, and, at the time at which the former attains substantially the latter, the microcomputer 55 applies the switch-over signal to the power supply 16' (16'') so that the mode of heating with the hot air can be switched over to the mode of heating with the microwave energy. Employment of the circuit structure shown in FIG. 12 can also attain the desired automatic control of heating of an object 3 to be heated. Although the additional electric heaters 60, 60' (62, 62') are provided in FIGS. 10 and 11, the heating operation can be automatically controlled with high accuracy by virtue of the compensation of any variation of the radiation generated from these electric heaters.

It will be understood from the foregoing detailed description that the heating apparatus according to the present invention can operate with improved control performance due to the fact that the color sensor 22 senses the wavelength of light of visible spectrum range directed toward and reflected from the surface of an object 3 to be heated, and, on the basis of the sensed wavelength, the degree of charring of the surface of the object 3 is judged for controlling the heating operation.

In another form of the present invention, the color sensor 22 senses both the wavelength and the instensity of light reflected from the surface of an object 3 being heated, and, on the basis of the sensed wavelength and light intensity, the heating operation is controlled. In this case, the degree of charring of the surface of the object 3 can be judged as when such is judged by the eyes of a person so that the control performance can be greatly improved.

In another form of the present invention, the wavelength of radiation generated from the electric heaters 60 and 60' provided for heating an object 3 by radiant heat or the wavelength of radiation generated from the electric heaters 62 and 62' provided for burning away foul matters deposited in the path of light from the lamp 10 toward the object 3 and in the path of light reflected from the object 3 toward the color sensor 22, which wavelength provides noise adversely affecting the control when subject to a variation, is sensed by the second color sensor 22', 22'' which compensates a variation of the wavelength so as to greatly improve the control performance.

Although the electric heaters are specifically referred to as the heat source in the aforementioned embodiments of the present invention, the present invention is equally effectively applicable to a heating apparatus including any other heat source. Further, automatic control of the step of heating with high-frequency or microwave energy is also included in the scope of the present invention.

The present invention is also equally effectively applicable to, for example, thawing and warming of a foodstuff.

The present invention is also equally effectively applicable to a heating apparatus including a color sensor for sensing the wavelength of external light entering the heating chamber 1 through the finder of the door 4 or a light-intensity sensor for sensing the intensity of such external light.

Although the color sensor 22 is adapted to sense the wavelength and intensity of light reflected from the object 3 in one form of the present invention, the present invention is equally effectively applicable to such a heating apparatus in which a color sensor for sensing the wavelength and another color sensor for sensing the light intensity are separately provided.

Although the level adjuster 51 and the comparator 52 are shown connected to the subtractor 32' providing the wavelength signal $V_O'$ in FIG. 9, they may be connected to the logarithmic expander 56 providing the light intensity signal $V_M$.

The present invention is more effective when the lamp 10 can emit light of substantially uniform spectral characteristic regardless of a variation of the power supply voltage. Alternatively, a stabilized power supply may be provided for the lamp 10.

Although the spectrum of external light is generally substantially uniform, the present invention will be more effective when a filter such as a magic mirror is used as the view window of the door 4 of the heating chamber 1.

What is claimed is:

1. A heating apparatus comprising:

a heating chamber;

heating means capable of heating an object to be heated placed in said heating chamber so that the color of a surface of said object changes to a given extent as the heating progresses;

light source means emitting light of visible spectrum range illuminating the surface of said object placed in said heating chamber;

first photo sensor means for sensing the wavelength of light of visible spectrum range, reflected from the surface of said object being heated;

means for storing an output of said first photo sensor means at an initial heating stage in every heating cycle;

means for judging the degree of charring of the surface of said object in response to the value stored in said storing means and an output from said first photo sensor means which changes in accordance with heating progress;

means for controlling the heating operation of said heating means in response to an output from said judging means; and second photo sensor means for sensing the intensity of light reflected from the surface of said object being heated, said judging means judging the degree of charring of the surface of said object in response to the output from said first sensor means as well as an output from said second photo sensor means.

2. A heating apparatus as claimed in claim 1, wherein said first photo sensor means includes first and second photodiodes responsive to different wavelengths of light and providing an output signal in accordance therewith, first and second logarithmic compressor means receiving the output signal of a respective photodiode and providing an output signal in accordance therewith, and subtractor means for subtracting the output signals from the first and second logarithmic compressor means and providing an output signal indicative of the sensed wavelength of light visible spectrum range.

3. A heating apparatus comprising:

a heating chamber;

heating means capable of heating an object to be heated placed in said heating chamber so that the color of a surface of said object changes to a given extent as the heating progresses;

light source means emitting light of visible spectrum range illuminating the surface of said object placed in said heating chamber;

first photo sensor means for sensing the wavelength of light of visible spectrum range, reflected from the surface of said object being heated;

means for storing an output of said first photo sensor means at an initial heating stage in every heating cycle;

means for judging the degree of charring of the surface of said object in response to the value stored in said storing means and an output from said first photo sensor means which changes in accordance with heating progress;

means for controlling the heating operation of said heating means in response to an output from said judging means; and second photo sensor means separate from said first photo sensor means for sensing the wavelength of light of visible spectrum range related to light illuminating said object being heated and for providing an output indicative thereof as a compensating signal for the output of said first photo sensor means, said judging means judging the degree of charring of the surface of said object in response to the output from said first photo sensor means as well as the compensating signal of said second photo sensor means.

4. A heating apparatus as claimed in claim 3, wherein said heating means heats said object by radiant heat, and said second separate photo sensor means senses the wavelength of light of visible spectrum range of radiation generated from said heating means and provides the compensating signal indicative thereof to said judging means.

5. A heating apparatus comprising:

a heating chamber;

heating means capable of heating an object to be heated placed in said heating chamber so that the color of a surface of said object changes to a given extent as the heating progresses;

light source means emitting light of visible spectrum range illuminating the surface of said object placed in said heating chamber;

first photo sensor means for sensing the wavelength of light of visible spectrum range, reflected from the surface of said object being heated;

means for storing an output of said first photo sensor means at an initial heating stage in every heating cycle;

means for judging the degree of charring of the surface of said object in response to the value stored in said storing means and an output from said first photo sensor means which changes in accordance with heating progress;

means for controlling the heating operation of said heating means in response to an output from said judging means;

second photo sensor means for sensing the wavelength of light of visible spectrum range related to light illuminating said object being heated, said judging means judging the degree of charring of the surface of said object in response to the output from said first sensor means as well as an output of said second photo sensor means; and auxiliary heating means for burning away external matter located in at least one of paths from said light source means toward said object and paths from said object toward said first and second photo sensor means, said second photosensor means sensing the wavelength of light visible spectrum range of radiation generated from said auxiliary heating means.

* * * * *